US005913450A

United States Patent [19]

Runkel

[11] Patent Number: 5,913,450

[45] Date of Patent: Jun. 22, 1999

[54] ANTI-DRIP PAINT CAN ATTACHMENT

[76] Inventor: Al H. Runkel, 4210 Ironwood Cir., Bradenton, Fla. 34209

[21] Appl. No.: 09/026,992

[22] Filed: Feb. 19, 1998

[51] Int. Cl.[6] ..... B65D 25/42

[52] U.S. Cl. ..... 220/696; 220/697; 220/700; 220/710.5; 220/736; 220/741

[58] Field of Search ..... 220/741, 736, 220/738, 700, 701, 742, 739, 696, 657, 710.5

[56] References Cited

U.S. PATENT DOCUMENTS

| | | | |
|---|---|---|---|
| 1,698,403 | 1/1929 | Harris | 220/736 |
| 2,783,077 | 2/1957 | Digrce | 220/736 |
| 4,116,332 | 9/1978 | Hartley | 206/209 |
| 4,266,686 | 5/1981 | Carter | 220/90 |
| 4,911,319 | 3/1990 | DeJean | 220/4 A |
| 5,161,689 | 11/1992 | Balson | 206/509 |
| 5,568,879 | 10/1996 | Kovathana | 220/697 |
| 5,626,258 | 5/1997 | Maiorino | 220/695 |
| 5,683,009 | 11/1997 | King | 220/736 |

FOREIGN PATENT DOCUMENTS

| | | | |
|---|---|---|---|
| 802730 | 5/1954 | United Kingdom | 220/736 |

*Primary Examiner*—Joseph M. Moy
*Attorney, Agent, or Firm*—Joseph N. Breaux

[57] ABSTRACT

An anti-drip paint can attachment that is securable to a paint can and that includes a circular gripping ring terminating in a pair of opposed pressure plates each having a screw aperture formed therethrough; a screw and wing nut combination, the screw being positionable through both of the screw apertures of the pressure plates; a handle assembly extending upward from the gripping ring and including a gripping handle, a paint brush clamp and a funnel member support structure; and a funnel member supported by the funnel member support structure above and concentric with the circular gripping ring.

6 Claims, 1 Drawing Sheet

ANTI-DRIP PAINT CAN ATTACHMENT

TECHNICAL FIELD

The present invention relates to painting equipment and more particularly to an anti-drip paint can attachment that is securable to a paint can and that includes a circular gripping ring terminating in a pair of opposed pressure plates each having a screw aperture formed therethrough; a screw and wing nut combination, the screw being position able through both of the screw apertures of the pressure plates; a handle assembly extending upward from the gripping ring and including a gripping handle, a paint brush clamp and a funnel member support structure; and a funnel member supported by the funnel member support structure above and concentric with the circular gripping ring.

BACKGROUND ART

It is often desirable to put down a paint brush for brief periods of time while painting. It is also desirable to have a surface against which to tap or rub a paint brush to adjust the loading of the paint brush with paint. Although many individuals utilize the side of the paint can for this purpose, this procedure can lead to paint dripping down the side of the paint can and onto undesired surfaces. It would be a benefit, therefore, to have a paint can attachment that included a clamp for holding the bristles of a paint brush suspended above the paint can opening and a funnel having an opening through which the paint brush bristles could be dipped into the paint can to load the paint brush bristles that included a surface supported above the paint can opening and against which the user could tip or rub the bristles of the paint brush to adjust the loading of the paint brush to the desired degree.

GENERAL SUMMARY DISCUSSION OF INVENTION

It is thus an object of the invention to provide an anti-drip paint can attachment that includes a clamp for holding the bristles of a paint brush suspended above the paint can opening and a funnel having an opening through which the paint brush bristles can be dipped into the paint can to load the paint brush bristles and a surface supported above the paint can opening and against which the user can tap or rub the bristles of the paint brush to adjust the loading of the paint brush to the desired degree.

It is a further object of the invention to provide an anti-drip paint can attachment that is securable to a paint can and that includes a circular gripping ring terminating in a pair of opposed pressure plates each having a screw aperture formed therethrough; a screw and wing nut combination, the screw being position able through both of the screw apertures of the pressure plates; a handle assembly extending upward from the gripping ring and including a gripping handle, a paint brush clamp and a funnel member support structure; and a funnel member supported by the funnel member support structure above and concentric with the circular gripping ring.

It is a still further object of the invention to provide an anti-drip paint can attachment that accomplishes both of the above objects in combination.

Accordingly, an anti-drip paint can attachment is provided. The anti-drip paint can attachment is securable to a paint can and includes a circular gripping ring terminating in a pair of opposed pressure plates each having a screw aperture formed therethrough; a screw and wing nut combination, the screw being position able through both of the screw apertures of the pressure plates; a handle assembly extending upward from the gripping ring and including a gripping handle, a paint brush clamp and a funnel member support structure; and a funnel member supported by the funnel member support structure above and concentric with the circular gripping ring.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
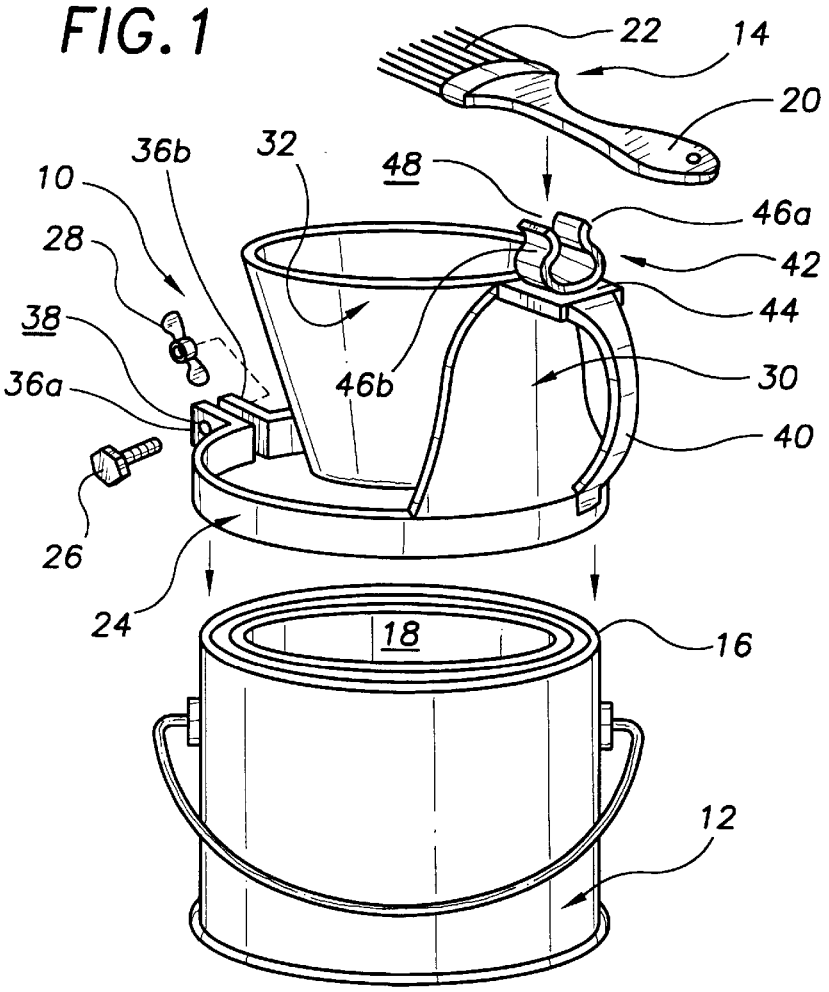
FIG. 1 is an exploded perspective view of an exemplary embodiment of the anti-drip paint can attachment in conjunction with a representative paint can having a can rim and a representative paint brush having a paint brush handle; the anti-drip paint can attachment including a circular gripping ring terminating in a pair of opposed pressure plates each having a screw aperture formed therethrough; a screw and wing nut combination, the screw being position able through both of the screw apertures of the pressure plates; a handle assembly extending upward from the gripping ring and including a gripping handle, a paint brush clamp and a funnel member support structure; and a funnel member supported by tie funnel member support structure above and concentric with the circular gripping ring.

FIG. 1 shows an exemplary embodiment of the anti-drip paint can attachment of the present invention, generally designated by the numeral 10, along with a representative paint can, generally designated 12, and a representative paint brush, generally designated 14. Representative paint can 12 is a conventional one gallon metal paint can including a can rim 16 defining a paint can opening 18. Representative paint brush 14 is of conventional paint brush construction and includes a brush handle 20 and a number of bristles 22.

In this embodiment, anti-drip paint can attachment 10 includes a circular gripping ring, generally designated 24; a screw 26; a wing nut 28; a handle assembly, generally designated 30; and a funnel member, generally designated 32. Circular gripping ring 24, handle assembly 30, and funnel member 32 are of molded nylon construction. Circular gripping ring 24 has a split therethrough and includes a pair of opposed pressure plates 36*a*, 36*b* each having a screw aperture 38 (only one shown) formed therethrough. In this embodiment, screw 26 and wing nut 28 are also of nylon construction. Screw 26 is position able through both screw apertures 38 and wing nut 28 is used to compress pressure plates 36*a*, 36*b* together to pull gripping ring 24 securely about paint can rim 16.

Figure 2:
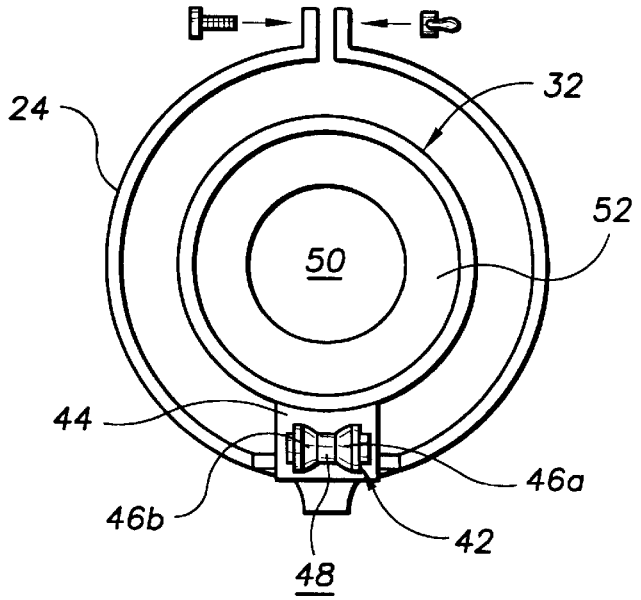
FIG. 2 is a top plan view of the anti-drip paint can attachment in isolation showing the circular gripping ring terminating in a pair of opposed pressure plates; the screw and wing nut combination; the handle assembly including the gripping handle, the paint brush clamp and the funnel member support structure; and the funnel member supported above and concentric with the circular gripping ring.

Handle assembly 30 extends upward from gripping ring 24 and includes a gripping handle 40, a paint brush clamp, generally designated 42, and a rectangular funnel member support structure 44. Paint brush clamp 42 includes a pair of resiliently opposed clamp members 46*a*, 46*b* that form, with reference now to FIG. 2, an insertion channel 48 through which paint brush handle 20 (FIG. 1) is inserted.

Funnel member 32 is supported by funnel member support structure 44 above and concentric with circular gripping ring 24. Funnel member 32 has a downwardly tapering shape that opens at the bottom thereof in a brush dipping opening 50. The internal sidewall 52 of funnel member 32 provide a surface against which the user can adjust the loading of the paint brush during use.

It can be seen from the preceding description that an anti-drip paint can attachment has been provided that includes a clamp for holding the bristles of a paint brush suspended above the paint can opening and a funnel having an opening through which the paint brush bristles can be dipped into the paint can to load the paint brush bristles and a surface supported above the paint can opening and against which the user can tap or rub the bristles of the paint brush to adjust the loading of the paint brush to the desired degree; that is securable to a paint can; and that includes a circular gripping ring terminating in a pair of opposed pressure plates each having a screw aperture formed therethrough; a screw and wing nut combination, the strew being position able through both of the screw apertures of the pressure plates; a handle assembly extending upward from the gripping ring and including a gripping handle, a paint brush clamp and a funnel member support structure; and a funnel member supported by the funnel member support structure above and concentric with the circular gripping ring.

It is noted that the embodiment of the anti-drip paint can attachment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An anti-drip paint can attachment comprising:

a circular gripping ring terminating in a pair of opposed pressure plates each having a screw aperture formed therethrough;

a screw and nut combination, said screw being positionable through both of said screw apertures of said pressure plates;

a handle assembly extending upward from said gripping ring and including a gripping handle and a funnel member support structure; and a funnel member supported by said funnel member support structure above and concentric with said circular gripping ring.

2. The anti-drip paint can attachment of claim 1, wherein:

said handle assembly further includes a paint brush clamp.

3. The anti-drip paint can attachment of claim 2, wherein:

said paint brush clamp includes a pair of resiliently opposed clamp members that form an insertion channel.

4. The anti-drip paint can attachment of claim 1 wherein:

said circular griping ring is of molded nylon construction.

5. The anti-drip paint can attachment of claim 4, wherein:

said handle assembly further includes a paint brush clamp.

6. The anti-drip paint can attachment of claim 5, wherein:

said paint brush clamp includes a pair of resiliently opposed clamp members that form an insertion channel.

* * * * *